US005737828A

United States Patent [19]

Barnes

[11] Patent Number: 5,737,828

[45] Date of Patent: Apr. 14, 1998

[54] CONTINUOUS HEAT EXCHANGER FORMING APPARATUS

[75] Inventor: David A. Barnes, Jacksonville, Tex.

[73] Assignee: American Standard Inc., Piscataway, N.J.

[21] Appl. No.: 665,933

[22] Filed: Jun. 19, 1996

[51] Int. Cl.[6] ..... B23P 15/00

[52] U.S. Cl. ..... 29/727; 29/726; 29/890.043

[58] Field of Search ..... 29/727, 726, 33 G, 29/33 T, 890.043; 165/175, 172, 163

[56] References Cited

U.S. PATENT DOCUMENTS

| | | | |
|---|---|---|---|
| 4,077,116 | 3/1978 | Cunningham et al. | 29/727 |
| 4,085,488 | 4/1978 | Hanert et al. | 29/33 |
| 4,350,936 | 9/1982 | Jackson | 318/7 |
| 4,429,737 | 2/1984 | McManus et al. | 165/125 |
| 4,434,841 | 3/1984 | Jackson et al. | 165/125 |
| 4,535,838 | 8/1985 | Gray et al. | 165/134 |
| 4,619,024 | 10/1986 | McManus et al. | 29/157 |
| 4,619,025 | 10/1986 | McManus et al. | 29/157 |
| 4,633,941 | 1/1987 | McManus | 165/172 |
| 4,770,141 | 9/1988 | McManus | 165/172 |
| 5,099,574 | 3/1992 | Paulman et al. | 29/890 |
| 5,228,198 | 7/1993 | Paulman et al. | 29/890 |

*Primary Examiner*—Irene Cuda

*Attorney, Agent, or Firm*—Willliam J. Beres; William O'Driscoll; Peter D. Ferguson

[57] ABSTRACT

A device for continuously forming a heat exchanger that has a helically wound fin tube coil formed by a plurality of wraps includes a rotationally driven mandrel with a central axis and a plurality of forming corners equiangularly disposed about and displaced from the central axis. The rotation of the mandrel is about the central axis in order to wind the fin tube coils onto the mandrel. A forming block is operably rotationally coupled to the mandrel and rotates with the mandrel. The forming block is also slideably engaged with the mandrel for axial translation a selected distance with respect to the mandrel. The forming block guides the winding of the fin tub coils onto the mandrel. An actuator is operably coupled to the forming block and causes the axial translation of the forming block. The axial translation is selectively timed with the rotation of the mandrel forming corners, whereby the wraps of the fin tube coil wound on the mandrel are iteratively axially translated with respect to the mandrel to define a continuous helix having a desired wrap pitch, shape, and spacing.

21 Claims, 10 Drawing Sheets

FIG. 4
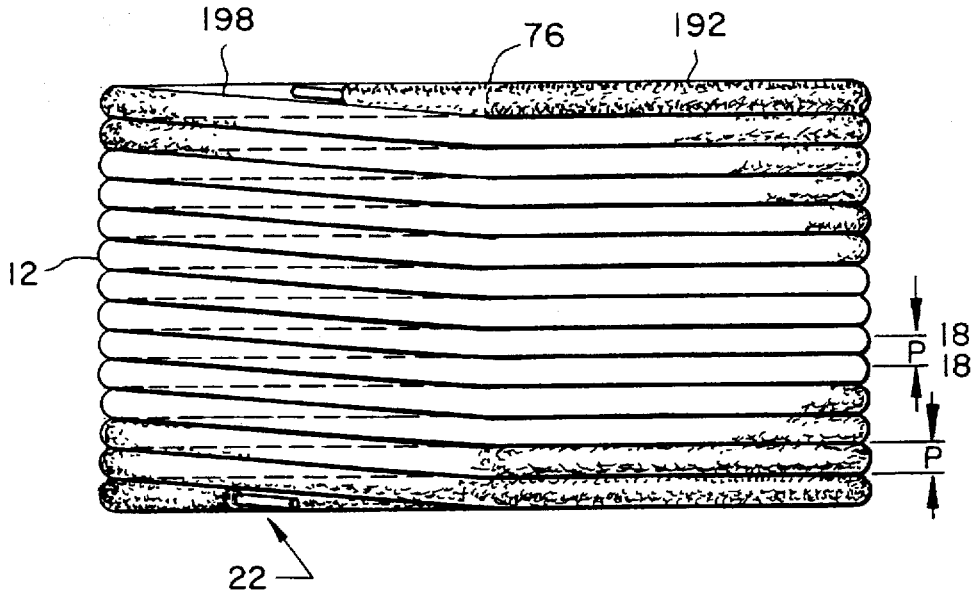
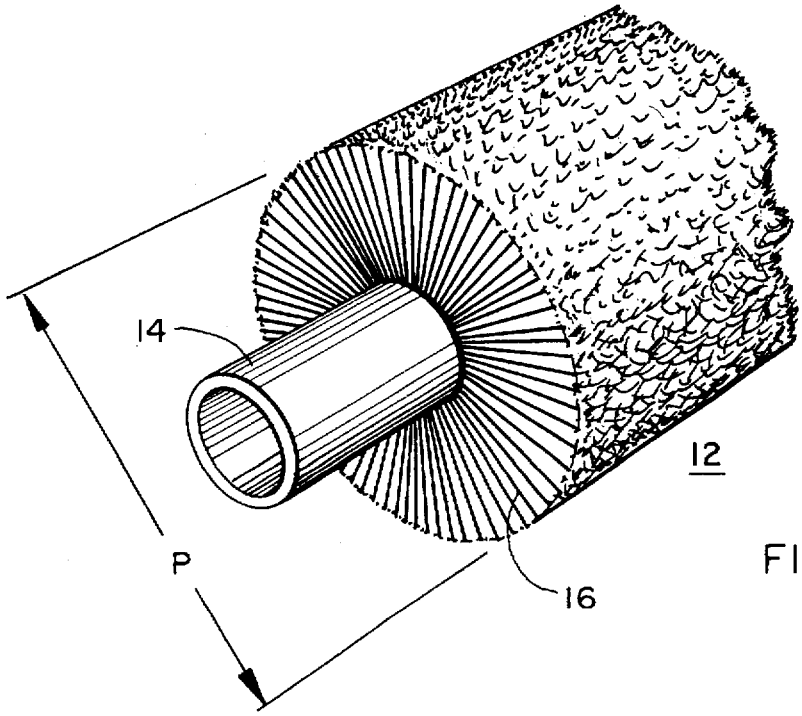
FIG. 2

CONTINUOUS HEAT EXCHANGER FORMING APPARATUS

TECHNICAL FIELD

The present invention pertains broadly to the field of heat exchangers, and specifically to an apparatus for continuously forming wound, spine fin coil type heat exchangers.

BACKGROUND OF THE INVENTION

Helically wound fin tube coils are frequently used for outdoor heat exchangers in air conditioning units including cooling-only units and heat pumps. The wound coils provide an adequate heat exchange surface for the outdoor heat exchanger in an acceptable size, and can be relatively inexpensively manufactured, particularly for residential size units. The outdoor heat exchanger of the air conditioner frequently includes a plurality of circuits, and the coil may be wound in generally rectangular or annular shapes. The coil is disposed on a frame or base, with a guard disposed there around and a cover or grill disposed on the top thereof for protection, the guard, cover and base essentially defining the perimeter of the outdoor unit. Arranged within the space defined by the coil of conventional units are the compressor, outdoor fan, inlet and outlet manifolds, expansion valves, check valves, filters driers and, in a heat pump, a reversing valve, with appropriate interconnecting refrigerant lines therebetween. A compact outdoor unit is thus provided, requiring only hookup to the indoor heat exchanger and an electric power source. A typical coil is shown in U.S. Pat. No. 4,535,838 to Gray et al. This patent is commonly assigned with the present invention and incorporated by reference herein.

Typical manufacturing methods for such coils include winding the entire coil, either vertically or horizontally, from a continuous length of fin tubing, and thereafter determining in which wraps inlets and outlets for adjacent circuits should be made.

Virtually all helically wound fin tube coils are formed around a mandrel. A number of devices have been designed to noncontinuously perform the helical winding operations. Such devices include a tube guide mounted on a lead screw for helically advancing the coil onto the mandrel as shown in U.S. Pat. No. 5,099,574 to Paulman et al. U.S. Pat. No. 4,085,488 to Hanert et al. discloses a geared, translating tube guide that is driven on wheels across a surface to advance the tube onto a mandrel. A rotating cylindrical feed device is disclosed in U.S. Pat. No. 4,077,116 to Cunningham et al. The cylindrical feeder that is disclosed is oriented transverse to the mandrel and rotation of the feeder through approximately one-third of a revolution advances the tube onto the mandrel.

Several additional patents are of interest in showing the state of the art. There is a series of patents to McManus and to McManus et al., all of which are assigned to the same assignee and include U.S. Pat. Nos. 4,619,024; 4,619,025; 4,633,941; and 4,770,241. These patents disclose winding of the tubing around two spaced-apart upright posts. The posts with the wound tube in place are then advanced around a stationary mandrel to generate a partially closed four sided heat exchanger.

It would be a decided advantage in the industry to be able to continuously form helically wound fin tube coils. Further, it would be advantageous if the device performing continuous helical formation were adaptable to form heat exchanger coils having a selected number of sides. The device should additionally reduce the floor space required to manufacture the heat exchanges and should also reduce the number of operations needed for forming multi-circuit heat exchangers. It would also be desirable to cut the helical coil at selected locations in order to form circuits having a desired length.

SUMMARY OF THE INVENTION

It is an object, feature and advantage of the present invention to solve the problems of the prior art by simplifying the manufacturing apparatus.

It is an object, feature and advantage of the present invention to continuously form a spine fin heat exchanger coil.

It is an object, feature and advantage of the present invention to continually shift a heat exchanger coil away form the location where coil wraps are formed.

It is an object, feature and advantage of the present invention to eliminate outwardly bowed sides in a spine fin heat exchanger by imparting a rising bend to stock tubing before it is wound on a mandrel.

It is an object, feature and advantage of the present invention to provide a spine fin manufacturing method and apparatus where the stock guide is stationary. This has the further advantage that the spool of spine fin tubing can be moved closer to the manufacturing apparatus, reducing whipping of the spine fin tubing as the tubing is pulled off the spool and through the air to the stock guide. This has an additional advantage in freeing up valuable manufacturing floor space by moving the spool considerably closer to the stock guide.

It is an object, feature and an advantage of the present invention to manufacture a spine fin coil with a flat base. This eliminates the need for levelers below the coil.

It is a further object, feature and an advantage of the present invention to provide a spine fin coil with a flat top, thus eliminating any need for levelers between the coil top and a unit cover.

The present invention substantially meets the aforementioned needs in the industry. By periodically advancing the tube along the mandrel, it is possible to continuously form the helically wound fin tube coils. The floor space needed to produce the helically wound fin tube coils is substantially reduced with the present invention due to the fact that the stationary stock guide unit permits the spool containing the tube stock to be positioned substantially closer to the heat exchanger forming apparatus. By incorporating a cutter with the heat exchanger forming apparatus, the desired number of circuits in the heat exchanger can be formed continuously in a single operation. By continuously forming the heat exchanger with the desired number of circuits, the cost of producing the desired heat exchanger is substantially reduced.

The present invention is a forming device for continuously forming a heat exchanger that has a helically wound fin tube coil formed by a plurality of wraps. The forming device comprises a rotationally driven mandrel that has a central axis and a plurality of forming corners equiangularly disposed about and displaced from the central axis. The rotation of the mandrel is about the central axis in order to wind the fin tube coils onto the mandrel. A forming block is operably rotationally coupled to the mandrel and rotates with the mandrel. The forming block is also slideably engaged with the mandrel for axial translation a selected distance with respect to the mandrel. The forming block guides the winding of the fin tub coils onto the mandrel. A timed actuator is operably coupled to the forming block and causes the axial translation of the forming block. The axial translation is selectively timed with the rotation of the mandrel forming corners, whereby the wraps of the fin tube coil wound on the mandrel are iteratively axially translated with respect to the mandrel to define a continuous helix having a desired wrap pitch, shape, and spacing.

The present invention also provides a coil forming device. The device includes a rotatable shaft, motor apparatus operably engaged with the shaft for rotating the shaft, and a mandrel affixed to the shaft and rotating with the shaft. The device also includes a helix forming unit and a stationary stock guide. The helix forming unit is movably engaged with the mandrel so as to rotate with the mandrel and also freely transliterates in a direction generally perpendicular to the direction of rotation. The stationary stock guide is for feeding spine fin tubing to the helix forming unit.

The present invention further provides a method of manufacturing a heat exchanger coil. The method comprises the steps of: rotating a mandrel; supporting a helix forming unit on the mandrel so that the helix forming unit is movably engaged with the mandrel; transliterating the helix forming unit in a direction generally perpendicular to the direction of rotation of the mandrel; and feeding spine fin tubing to the helix forming unit.

The present invention additionally provides a heat exchanger including a central cavity, a coil arranged about the cavity, and a housing arranged about the coil. The coil includes at least first, second and third sides formed of spine fin tubing. The tubing of the first and second sides lies in a common plane. The tubing of the third side slopes from the common plane to a second plane parallel to the common plane but spaced from the common plane a distance approximately that of the tubings' diameter.

BRIEF DESCRIPTION OF THE DRAWINGS

FIG. 2 shows a perspective view of the spine fin tubing used to manufacture coils in accordance with the present invention.

FIG. 4 is a plan side view of the coil shown in Figure 3 centered on a corner and showing the two different side types of the coil.

Figure 5:
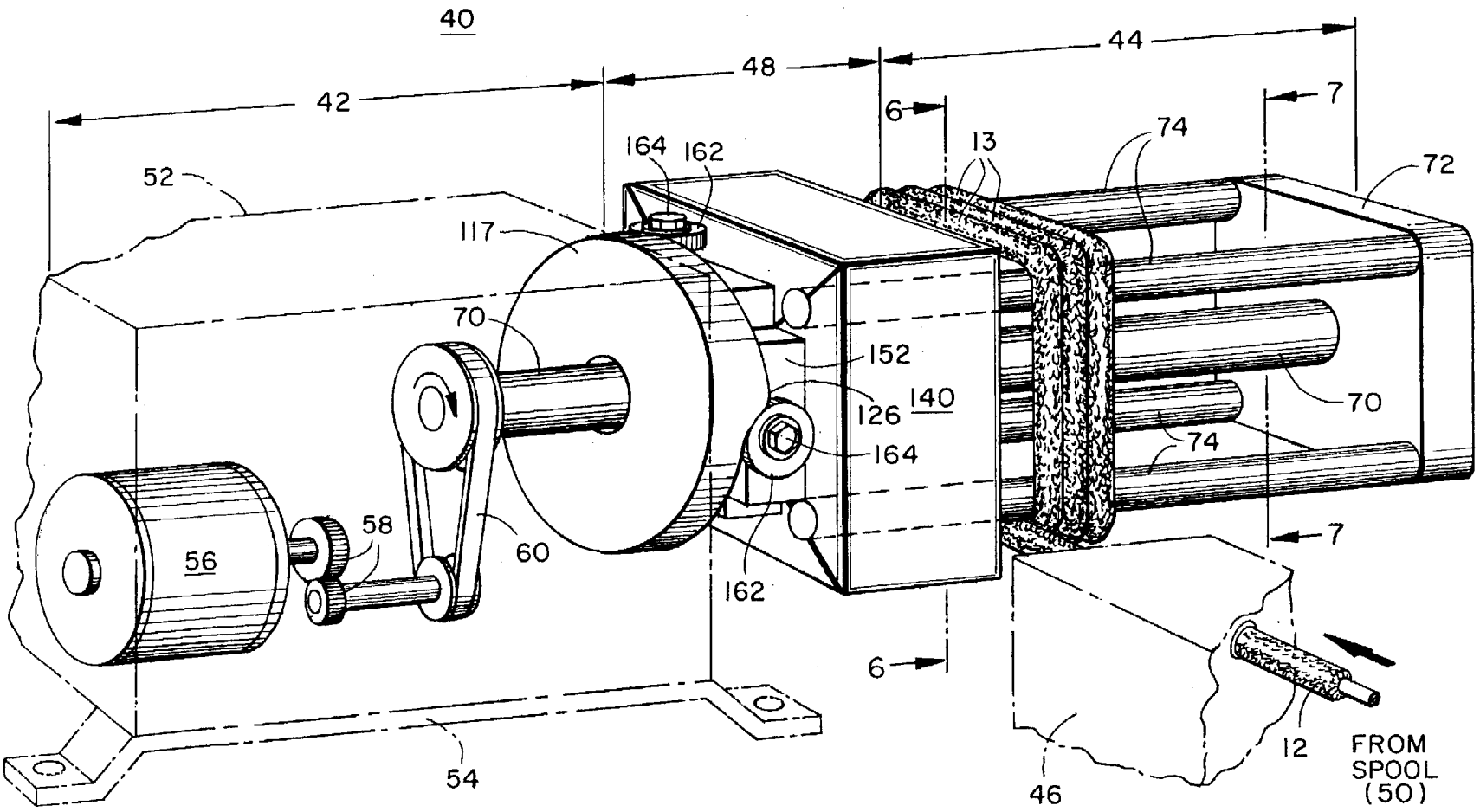
FIG. 5 is a perspective view of the apparatus of the present invention.
Figure 6D:
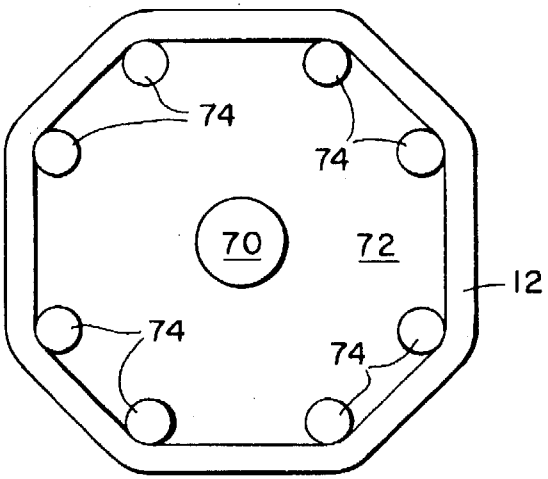
Figure 6C:
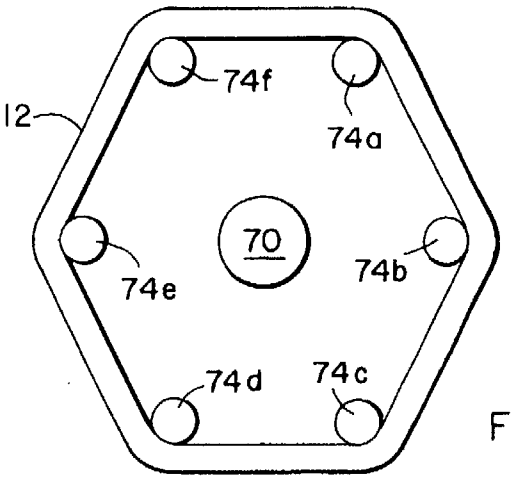
Figure 6A:
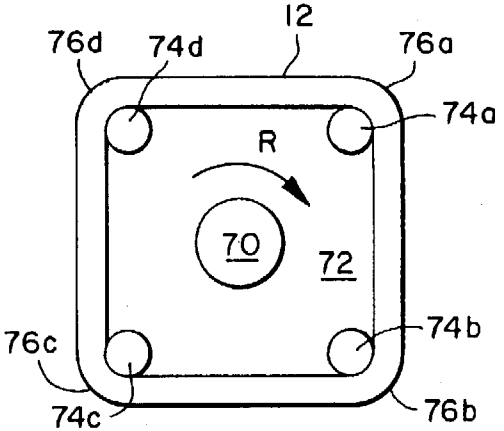
Figure 6E:
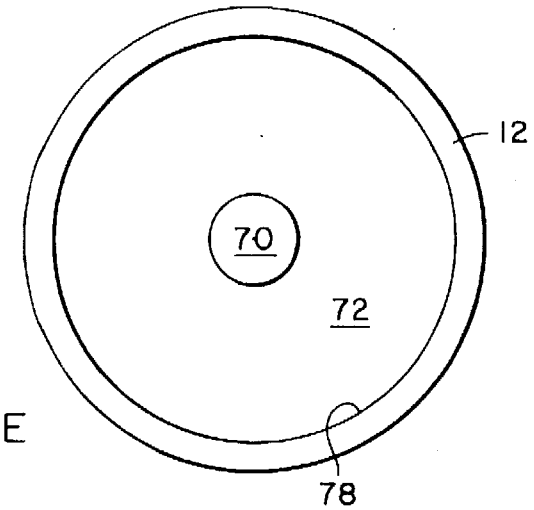
Figure 6B:
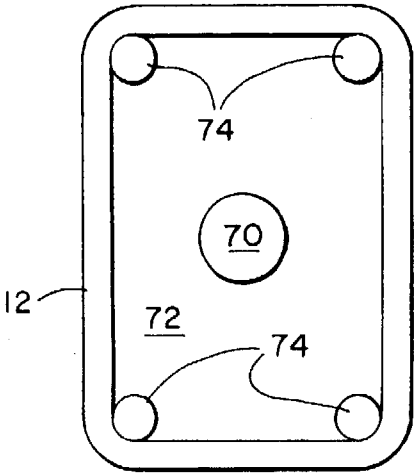

FIGS. *6a–6e* show various mandrel embodiments cutaway viewed along line 6—6 of FIG. 5.

Figure 7:
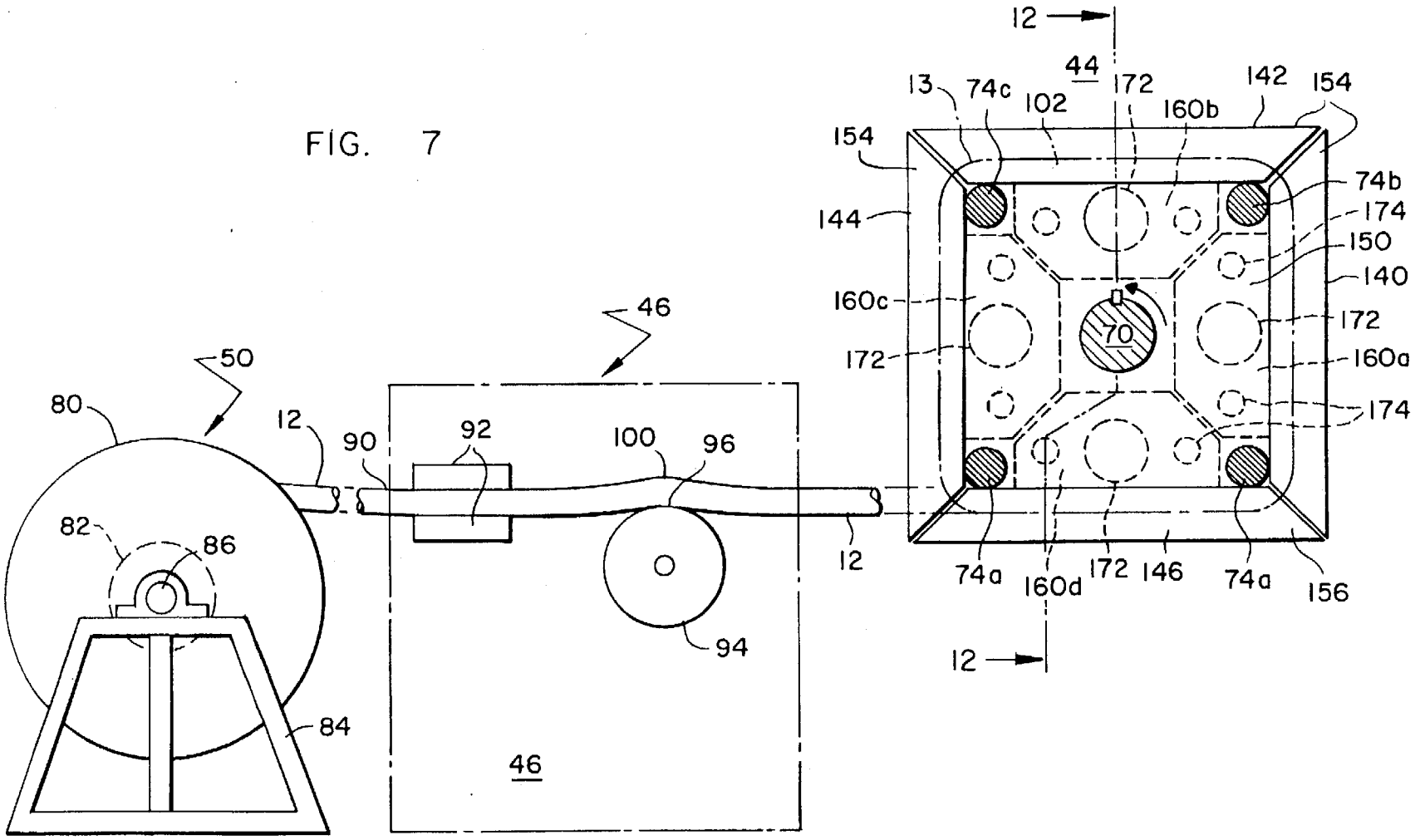

FIG. 7 shows the spool, the stock guide and the mandrel as cutaway along lines 7—7 of FIG. 5.

Figure 8:
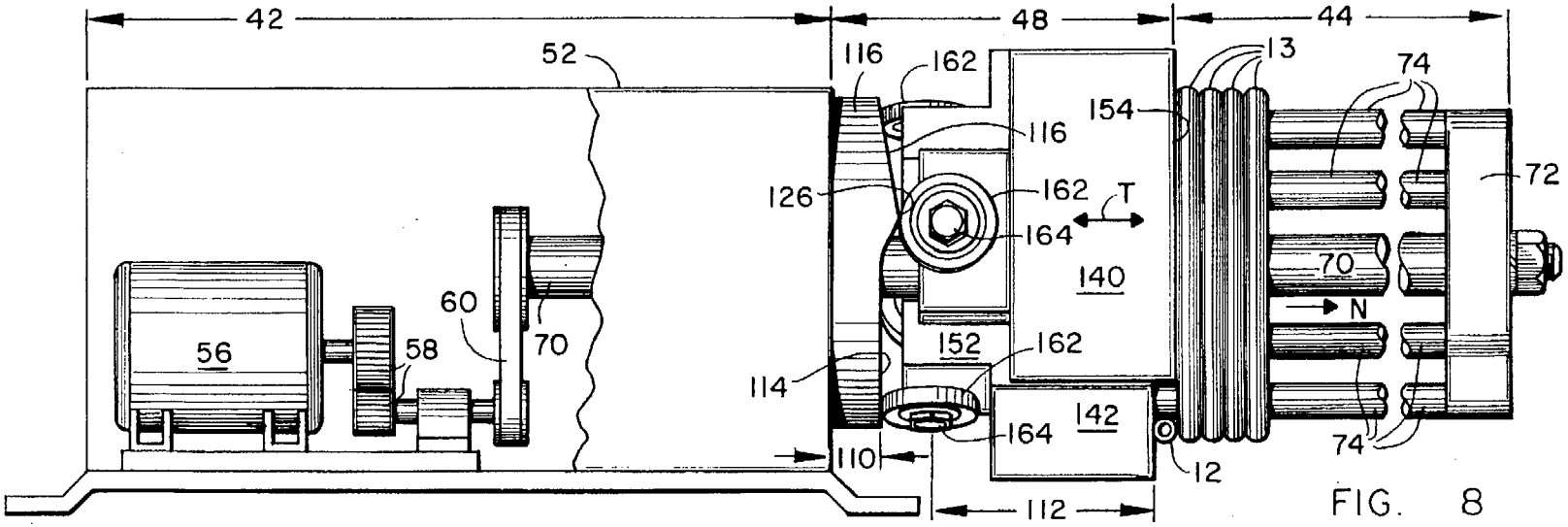

FIG. 8 is a side view of the apparatus of FIG. 5 where the forming block has shifted a flat side toward the mandrel end.

Figure 9:
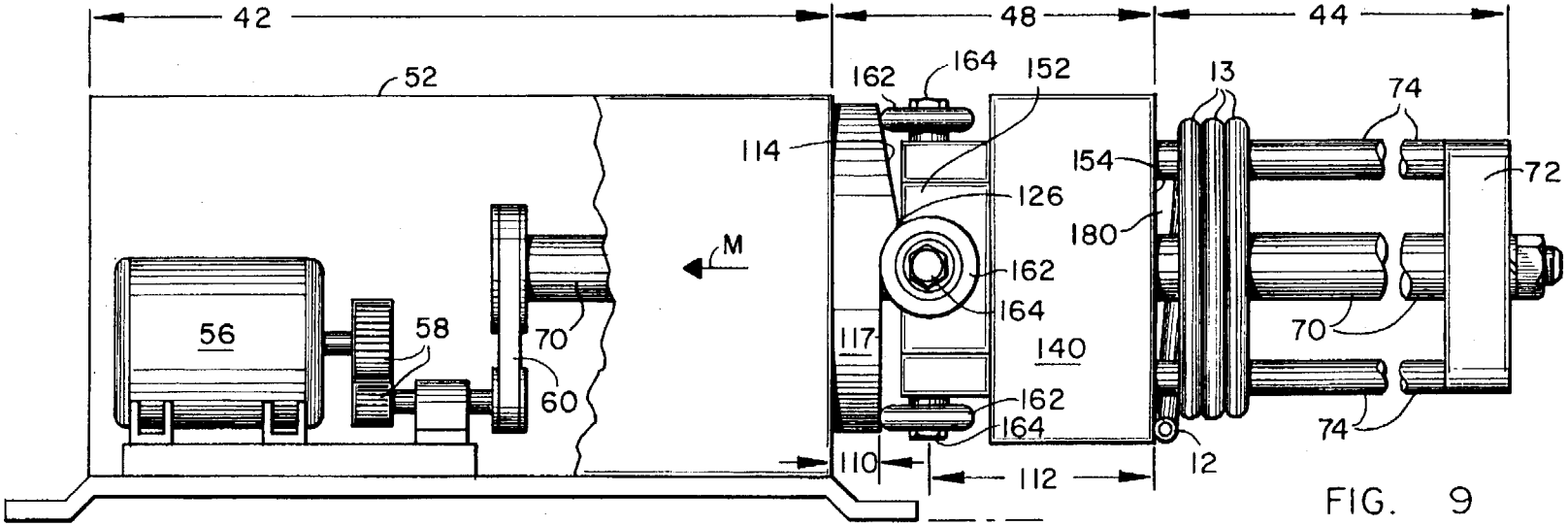

FIG. 9 is a side view of the apparatus of FIG. 8 where the forming block has retreated to provide space for the next wrap of coil.

Figure 10:
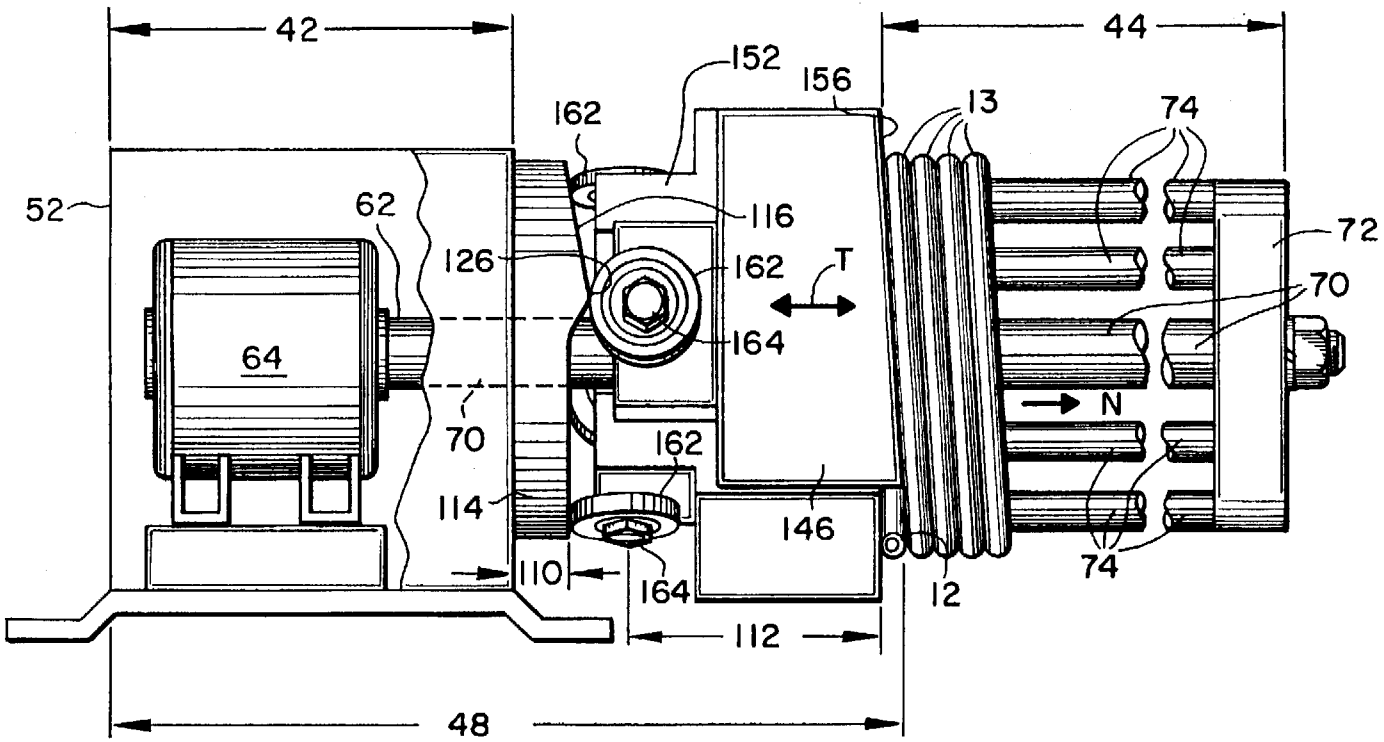

FIG. 10 is a side view of the apparatus of FIG. 5 where the forming block has shifted the sloped side toward the mandrel end.

Figure 11:
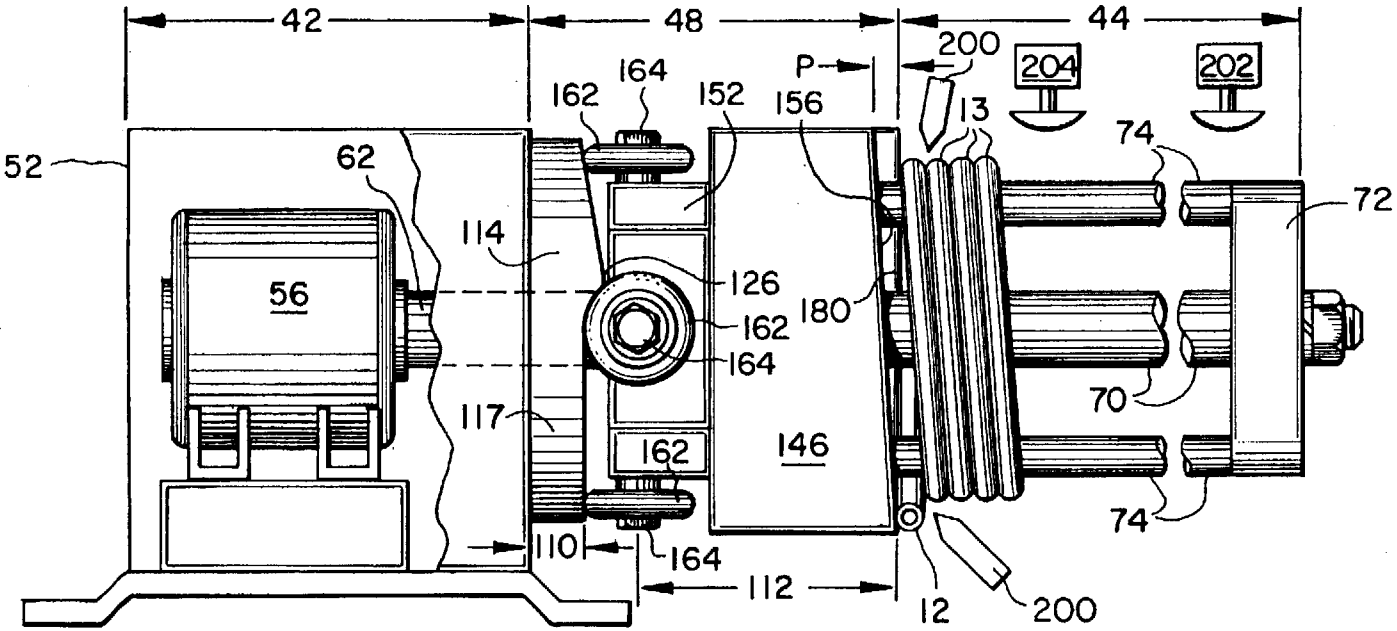

FIG. 11 is a side view of FIG. 10 where the forming block has retreated to provide space for the next wrap of coil.

Figure 12:
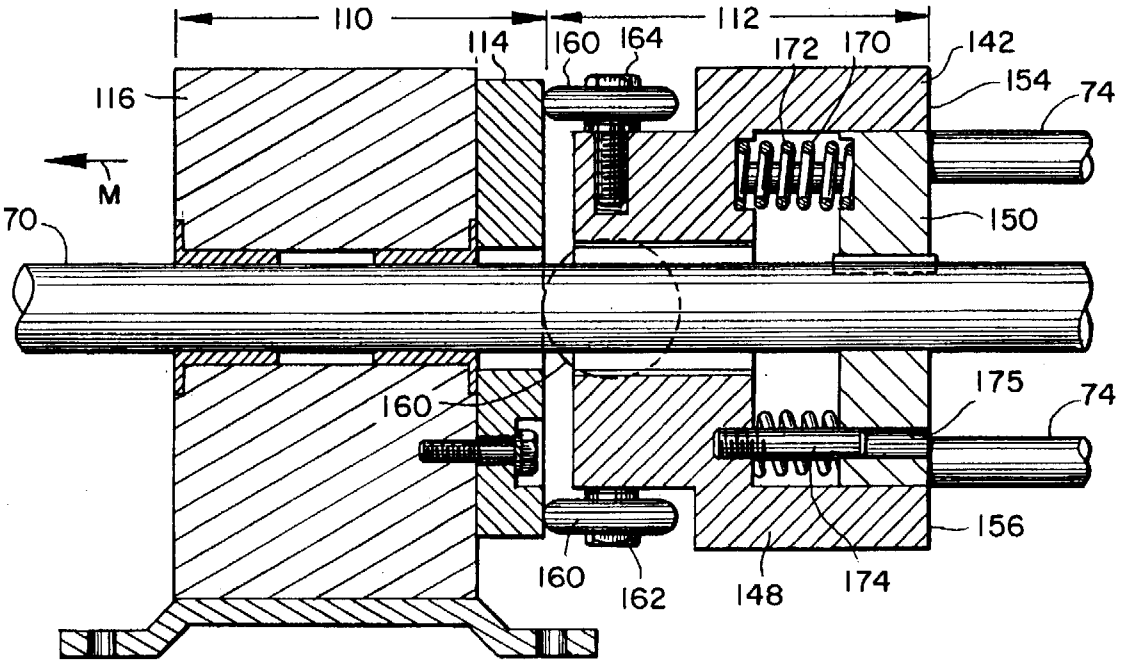

FIG. 12 is a section of the helix forming unit taken along lines 12—12 of FIG. 7.

Figure 13:
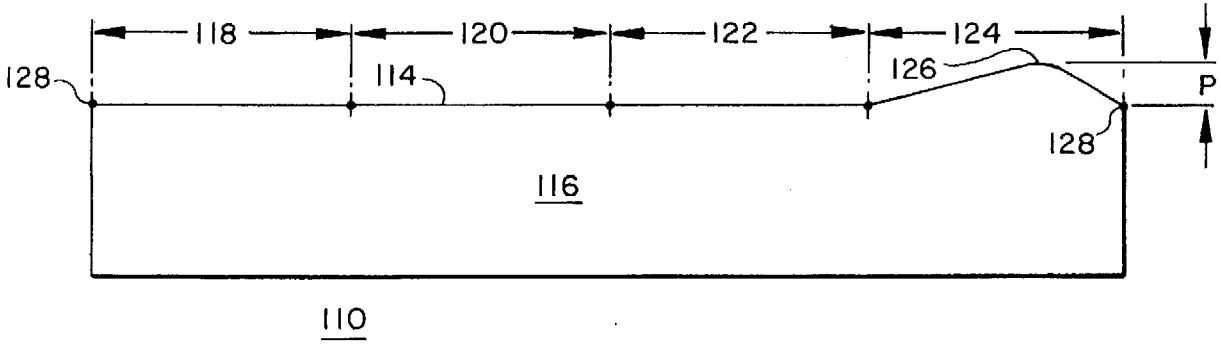

FIG. 13 shows a linear view of the circular cam.

Figure 14:
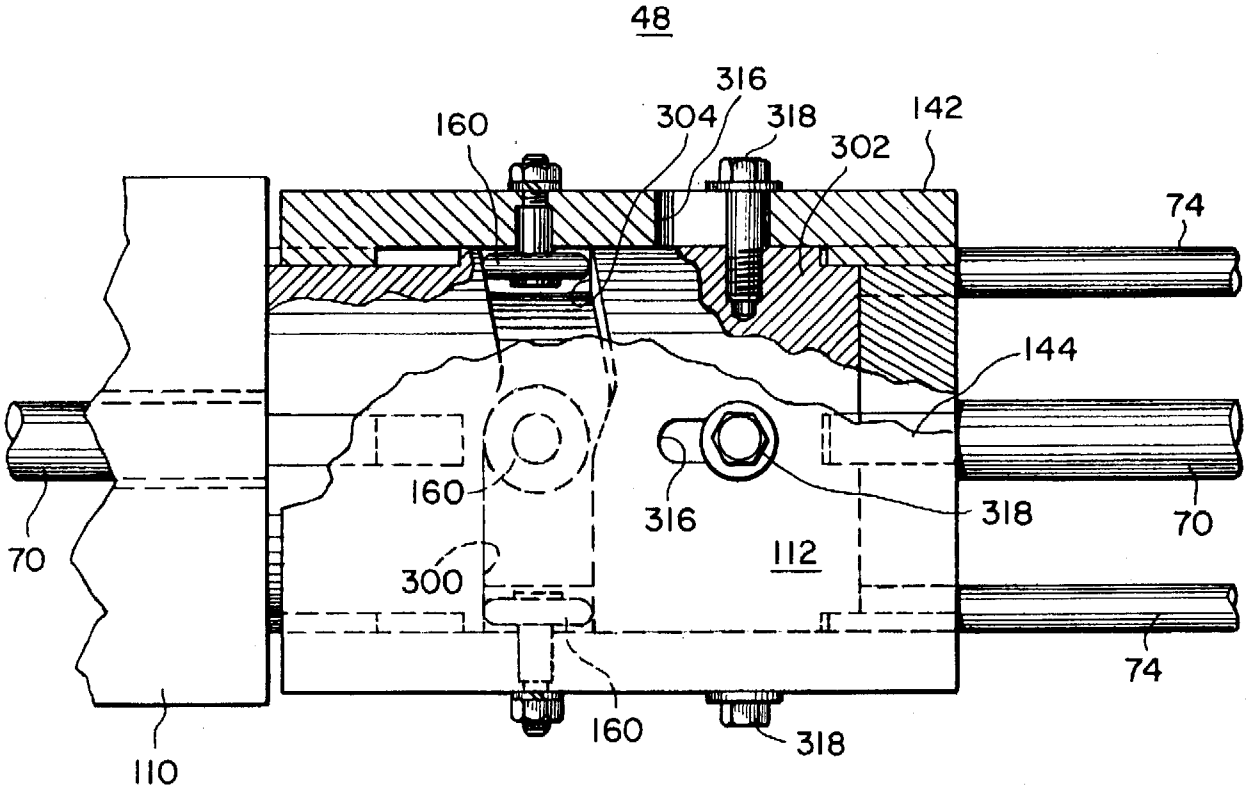

FIG. 14 shows an alternative helix forming unit.

DETAILED DESCRIPTION OF THE DRAWINGS

Figure 1:
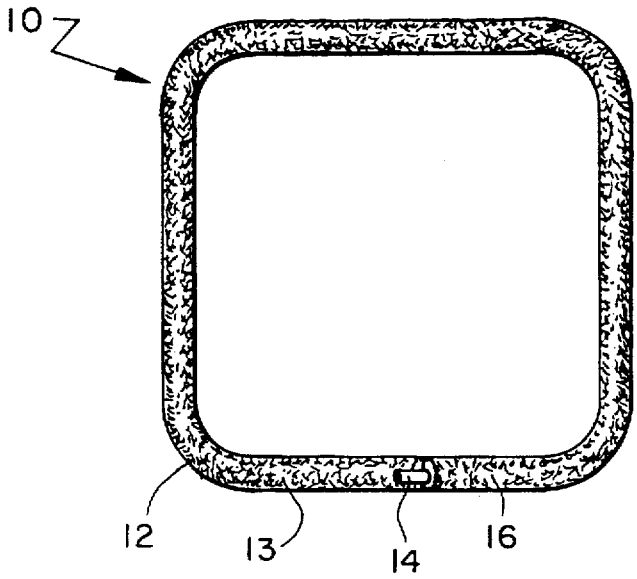
FIG. 1 is a top plan view showing a heat exchange coil following formation according to the present invention.

In manufacturing a fin tube coil 10 using the apparatus and method of the present invention, a continuous length of spine fin tubing 12 is wound on a mandrel 44 form to the desired configuration, such as the rectangular form depicted in FIG. 1. Each complete revolution of the mandrel produces one wrap 13 of the coil 10 around the mandrel 44. As shown in FIG. 2, the coil 10 is comprised of spine fin tubing 12. The spine fin tubing 12 includes a central tube 14 that is preferably made of aluminum. The central tube 14 is surrounded by spine fin material 16, also preferably made of aluminum, that functions to enhance the heat exchange capability of the coil 10. As depicted in FIG. 4, the distance between the center lines 18 of the central tubes 14 of adjacent wraps 13 of the coil 10 is generally equal to a diameter P of the spine fin material 16 enclosing the central tube 14. Accordingly, the spine fin material 10 of adjacent wraps of the coil 10 just touch at the outer margins thereof. The helical formation of the spine fin tubing 12 of the coil 10 is apparent in FIG. 2.

Figure 3:
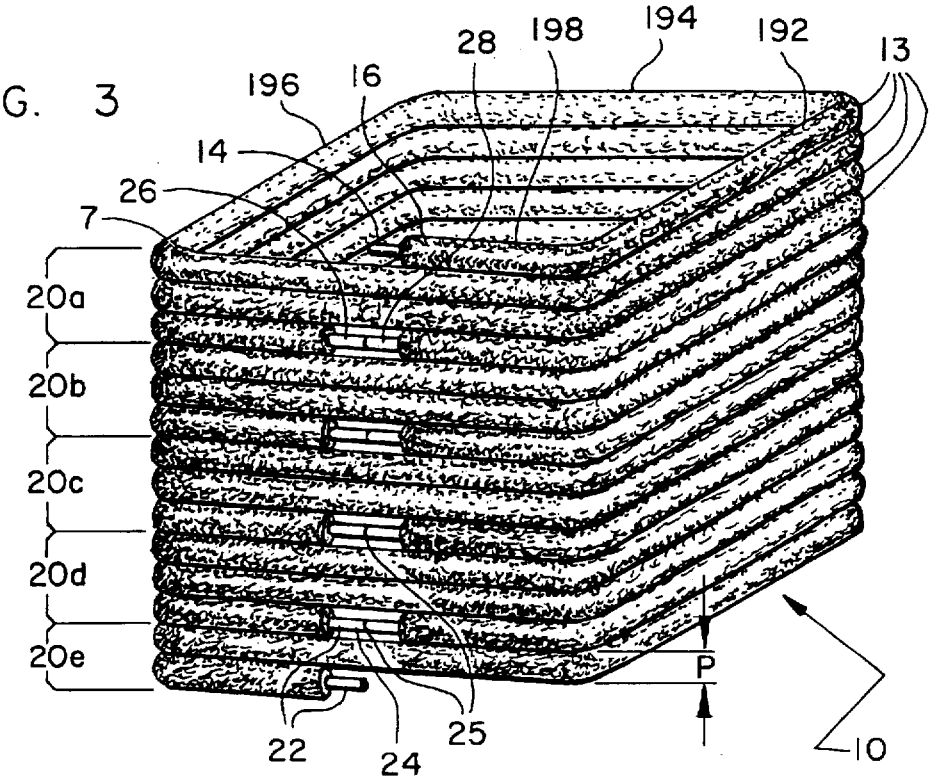
FIG. 3 is a perspective view of the coil shown in FIG. 1 showing the coil after the locations for circuit ends have been determined and initial cuts made.

During formation of the helically wound fin tube coils 10, after the desired number of wraps 13 of the coil 10 have been formed for the circuits 20 of the coil 10 (including in a subcooler, if desired) a location 22 for breaking the central tubes 14 to form the circuits 20 is determined. In the example as shown in FIG. 3, every third wrap 13 of the coil 10 was cut to form the circuits **20*a–e*. It is understood, however, that the number of wraps 13 in each circuit 20*a–e* may be varied to suit the requirement of a particular system or application. In forming a circuit 20, a small portion 24 of the spine fin material 16 is removed from the central tube 14 and the central tube 14 is cut at 25** and manifolded into a refrigeration circuit (not shown but see the Gray et al. patent).

FIG. 3 generally depicts a coil 10 at the afore-mentioned stage of manufacture, just after the cuts 25 have been made in the coil wraps 13 to divide the coil 10 into individual circuits 20. A single cut 25 is needed to form the lower end connection 26 of one circuit **20*a* and the upper end connection 28 of the next adjacent circuit 20*b*. In FIG. 3, the cuts 25 are shown dividing the coil 10 into the circuits 20*a–e***.

Alternatively, utilizing the apparatus of the present invention, the depicted cuts 25 may be made while the coil 10 is being formed on the mandrel 44 of the present invention.

The heat exchanger forming apparatus of the present invention is depicted generally at 40 in FIG. 5. The heat exchanger forming apparatus 40 includes four major subassemblies; a drive unit 42, a mandrel 44, a stock guide unit 46, and a helix forming unit 48. In FIG. 7, the heat exchanger forming apparatus 40 is depicted with a spool 50 disposed adjacent thereto for providing spine fin tubing 12 to the heat exchanger forming apparatus 40.

The drive unit 42 of the heat exchanger forming apparatus 40 is substantially contained within a drive unit cabinet 52. The drive unit cabinet 52 is affixed to a base 54. Preferably, as shown in FIGS. 5, 8 and 9, the drive unit 42 is comprised of an electrical motor 56, a reduction gearing 58, and a drive belt 60. The afore-mentioned components of the drive unit 42 are known to those skilled in the art and it can be conventionally modified as desired, including for example, the substitution of direct drive 62 or gear driven motors (see, for example, the direct drive motor 64 of FIGS. 10 and 11).

The drive unit 42 is rotatably coupled to the mandrel 44 by an axial shaft 70 for the rotation thereof.

The mandrel 44 of the heat exchanger forming apparatus 40 includes the axial shaft 70. The axial shaft 70 is fixedly coupled to and supports an end plate 72 of the mandrel 44. In the preferred embodiment, four winding posts 74*a–d* are equiangularly disposed around and supported by the end plate 72. As shown in FIG. 6(*a*), a cross section of the winding posts 74*a–d*shows that the winding posts 74*a–d* define a square shape having four forming corners 76*a–d*, respectively associated with the winding posts 74*a–d*, for forming the coil 10 as the spine fin tubing 12 is wound onto the mandrel 44. FIGS. 6(*b*), 6(*c*), 6(*d*) and 6(*e*) are exemplary of other cross-sections; FIG. 6(*b*) showing a rectangular cross-section for forming rectangular coils, FIG. 6(*c*) showing a hexagonal cross-section for forming hexagonal coils either in the hexagonal shape shown or in a regular hexagonal shape, FIG. 6(*d*) showing an octagonal cross-section for forming octagonal coils, and FIG. 6(*e*) showing a single, enlarged circular winding post 78 for forming circular coils. The winding posts 74*a–d* of FIGS. 6(*a*)–6(*d*) are preferably steel tubes having a radius of approximately one inch. The winding post 78 of FIG. 6(*e*) will have a diameter sized to dimension the desired coil. The mandrel 44 is preferably rotated in a direction R of FIG. 6(*a*) at approximately twenty-two revolutions per minute during the winding operations of the preferred embodiment.

The spool 50 is disposed spaced apart from the heat exchanger forming apparatus 40 by a distance of five to eight feet (about 1.5 to 2.4 meters). The spool 50 is comprised of end plates 80 fixedly coupled to both ends of an intermediate cylinder 82. The cylinder 82 preferably has an axially dimension of approximately two feet (about 0.6 meters), and spine fin tubing 12 is wound on the cylinder 82. The spine fin tubing 12 is comprised of a continuous length of the central tube 14 having the spine fin material 16 already affixed thereto. The spool 50 is typically supported on a frame 84 that has an axial shaft member 86 that is disposed within the cylinder 82 and about which the spool 50 is free to rotate.

The spine fin tubing 12 is unwound from the spool 50 and drawn through the stock guide unit 46 of the heat exchanger forming apparatus 40. The stock guide unit 46 can be affixed to the base 54 of the heat exchanger forming apparatus 40 or, alternatively, can be fixed in place in relation to the heat exchanger forming apparatus 40. Thus, unlike previous heat exchanger forming devices, the stock guide unit 46 is stationary with respect to the spool 50. Therefore, the spool 50 can be moved substantially closer to the heat exchanger forming apparatus 40 than in the previous heat exchanger forming devices. In these previous heat exchanger forming devices the stock guide unit translated axially back and forth (such as shown by arrow T of FIGS. 8 and 10) along a mandrel in order to locate the spine fin tubing 12 so as to generate the desired shape. This caused various bend angles in the tubing 12 resulting from the angle between the spool and the translating stock guide, and also resulting in bouncing or whipping of the tubing between the spool and the stock guide. These are eliminated in the present invention.

As shown in FIG. 7, the stock guide unit 46 has a stock inlet 90 for receiving the spine fin tubing 12 from the spool 50. Internal to the stock guide unit 46 are snubbers 92 that apply resistance to the spine fin tubing 12 as the spine fin tubing 12 is drawn through the stock guide unit 46. The resistance applied by the snubbers 92 imposes a desired amount of tension to the spine fin tubing 12 as the spine fin tubing 12 is wound onto the mandrel 44. Additionally, there is an idler pulley 94 disposed within the stock guide unit 46. As the spine fin tubing 12 is drawn through the stock guide unit 46, the spine fin tubing 12 is forced around an upper side 96 of the idler pulley 94. This action imparts a rising bend 100 to the spine fin tubing 12 prior to the spine fin tubing 12 being taken up on the mandrel 44. The rising bend 100 is opposite to the direction of bend that the mandrel 44 effects in the spine fin tubing 12 as the spine fin tubing 12 is wound onto the mandrel 44. The rising bend 100 formed in the spine fin tubing 12 helps to ensure that, as the spine fin tubing 12 is wound onto the mandrel 44, the portion 102 of the wrap 13 between the winding posts 74*b–c*, for example, does not bow outward, but runs very straight between the adjacent winding posts 74 so as to define a desired coil shape such as the tight square depicted in FIG. 1.

As shown in FIGS. 8, 9, 10, 11 and 12, the helix forming unit 48 of the heat exchanger forming apparatus 40 has two major subcomponents; a cam 110 and a forming block 112. The cam 110 is affixed to the drive unit cabinet 52 and includes a generally circular track 114. The cam 110 has a cam wall 116 which provides support for the cam track 114. As shown in the flattened out cam track 114 of FIG. 13, the cam 110 has segments 118, 120, 122, 124 formed end to end to define the circular track 114. In the preferred embodiment, the segments 118, 120 and 122 are substantially flat. The segment 124 has a peak 126 and a valley 128 defined by variations of height in the cam wall 116. The number of segments 118, 120, 122, 124 defined by the cam wall 116 are preferably selected to match the number of winding posts 74 of the mandrel 44. Accordingly, to form the hexagonally-shaped heat exchanger of FIG. 6(*c*), as distinct from the square shaped heat exchanger of FIG. 6(*a*), six winding posts 74*a–f* would be required in the mandrel 44 and the cam 110 would have six segments, one of which has a peak 126.

The forming block 112 of the helix forming unit 48 is rotationally coupled to the mandrel 44 by the axial shaft 70 and rotates with the mandrel 44 in the direction R, but is free to translate axially with respect to the mandrel 44 in the direction T along the winding posts 74, 78. Accordingly, as the mandrel 44 rotates, the mandrel 44 carries with it the helix forming unit 48. During such rotations, the forming block 112 translates back and forth axially in direction T on the mandrel 44 responsive to the camming action of the cam 110. More specifically, each side 140, 142, 144, 146 of the forming block 112 sequentially rotates to align with each segment 118, 120, 122, 124 and each side 140, 142, 144, 146 transliterates axially with the camming action of the cam 110.

The forming block 112 is comprised of a block 150 preferably formed of a metal material, such as steel sheet, and the sides 140, 142, 144, 146. The sides 140, 142, 144, 146 movably surround the block 150, and move axially relative to the block 150. The block 150 and the sides 140, 142, 144, 146 rotate with the mandrel 44 but the block 150 does not move axially.

Three of the sides 140, 142, 144 have a substantially flat forming face 154 that is disposed transverse to the shaft 70 of the mandrel 44. The fourth side 146 has a sloped forming face 156 which is offset from slope start to slope finish a distance P generally equal to the diameter P of the spine fin tubing 12.

A portion of each of the sides 140, 142, 144, 146 from a drum 152 which is generally cylindrical in shape, and includes four cam followers 160*a–d* disposed thereon. The cam followers 160*a–d* act to cause translation of the sides 140, 142, 144, 146 as depicted by arrow T of FIGS. 8–11. The cam followers 160*a–d* each include a roller 162 rotationally mounted on a stub axle 164 that is affixed to the drum 152 in a radial disposition. The cam followers 160*a–d* are radially disposed from the center line of the mandrel 44 a distance from the center line of the mandrel 44 so that the rollers 162 of the cam followers 160*a–d* ride on the cam track 114 of the cam 110 as the forming block 112 rotates with the mandrel 44. The four cam followers 160*a–d* are equiangularly spaced around the drum 152. Such spacing insures that each cam follower 160*a–d* is located at the same point on one of the four segments 118, 120, 122, 124 of the cam 110 at the same time. Accordingly, each cam followers 160*a–d* crests the peak 126 of the cam 60 at the same time during the rotation of the mandrel 44. Additionally, a timing is established with the rotation of the winding posts 74 of the mandrel 44 such that the cam followers 160*a–d* each crest the peak 126 of the cam 110 at the same time that a winding post 74 is passing the lowest point of the revolutionary travel of the winding posts 74. This is the point that the spine fin tubing 12 first comes in contact with the mandrel 44 during the winding operation.

Each cam follower 160*a–d* has associated with it a return mechanism 170 such as a spring 172. Each spring 172 abuts the block 150 of the forming block 112. The block 150 of the forming block 112 rotates with the mandrel 44 but does not translate with the sides 140, 144, 142, 148. Thus as each cam follower 160*a–d* translates toward the mandrel 44, the spring 172 is compressed to its maximum as the roller 162 crests the peak 126. As the roller 162 descends the slope to the valley 128, the spring 172 urges the respective cam follower 160*a–d* in the direction shown by arrow M of FIGS. 9 and 12. Pins 174 slideably disposed in bores 175 of the central portion 175 are provided to radially restrain the sides 140, 142, 144, 146 relative to the block 150.

FIG. 8 shows a view of the apparatus 40 with one of the flat sides 140, 142, 144 urged by the peak 126 towards the mandrel 44 its maximum amount of travel. The coil 10 is urged a distance P in direction N of FIG. 8. Formed coils 10 will eventually slide over the end plate 72, needing only separation by cutting the spine fin tubing 12 on the sloped side 146.

As the roller 162 rotates from the crest 126 to the valley 128, the side 140, 142, 144 returns a distance P, the diameter of the spine fin tubing 12. As shown in FIG. 9, a gap 180 is left into which spine fin tubing 12 from the stock guide 46 is fed. The roller 162 rolls on the flat segments 118, 120, 122 of the cam track 114 until it reaches the segment 124. When the segment 124 is reached, the respective roller rides up the segment to the peak 126, again urging the cam follower 160, the coil 10, and the respective side 140, 142, 144 in the direction N.

The FIGS. 10 and 11 are similar to FIGS. 8 and 9 in operation with the exception that the side 148 has the sloped face 156, and the sloped face 156 slopes a distance P from beginning to end to provide a transition from one wrap 13 to the next adjacent wrap 13. Consequently, with reference to FIG. 3, sides 192, 194 and 196 of the coil 10 will have essentially flat sides. These coil sides 192, 194, 196 are respectively formed by the flat surfaces 140, 142, 144. The fourth side 198 of the coil 10 is formed by the sloped face 156 and consequently has a sloped side as best shown in FIG. 4 wherein sides 198 and 192 can be compared. The finished heat exchanger coil 10 will therefore have three flat sides 192, 194 and 196 and one sloped side 198. This is unlike previous heat exchanger coils where all the sides are essentially identical and all sides are sloped. Since there are three flat sides 192, 194, 196, the base 199 of the finished coil 10 is flat, eliminating the need for levelers. Similarly, the top 197 of the finish coil 10 is flat, eliminating the need to level a cover (not shown).

The coil 10 is continuously manufactured on the mandrel 44 as each wrap 13 is urged in direction N as it is formed. The coil can be slid of the mandrel over the end plate 72. This allows a continuous heat exchanger manufacturing process, unlike the previous heat exchanger manufacturing processes where the manufacturing process had to be stopped and each coil removed as formed.

The operation of the heat exchanger forming apparatus 40 is best depicted in FIGS. 8–11. In FIG. 8 one of the sides 140, 142, 144 has moved in the direction N as the roller 162 traveled up the slope of the segment 124 to the peak 126. The flat surface 154 has correspondingly moved in the direction N, pushing the most recently formed wrap 13 and the entire coil in that direction N. As the roller 162 crests the peak 126 and heads downslope to the valley 128, the side 140, 142, 144 retreats as impelled by the spring 172. This is best shown in FIG. 9 where a gap 180 of the approximate size of the spine fin tubing 12 is left as the side 140, 142, 144 retreats. As the mandrel 44 continues to rotate, spine fin tubing 12 fills that gap 180, preferably during the segment 118 but potentially in the segments 120, 122.

FIG. 10 shows the sloped side 148, which operates similarly to that of FIGS. 8 and 9, but forms a sloped side 198 to act as a transition from one wrap 13 to the next wrap 13. In FIG. 10, the roller 162 is at the crest 126 causing the side 148 to move to its farthest position in direction N and causing the last wrap 13 as well as the coil 10 to also move in that direction N towards the end plate 72. As the roller 162 travels down the slope of segment 124 to the valley 128, the spring 172 causes the side 148 to retreat, leaving a gap 180 adapted to receive the next wrap 13 of spine fin tubing 12. The mandrel 44 rotates to fill that gap 180 with spine fin tubing 12.

This cycle repeats itself continuously and can be made almost totally automatic with the addition of a conventional gluing device and automatic cutters. A conventional gluing device such as an automatic glue gun 200 (see FIG. 11) automatically applies a dollop of glue on the spine fin tubing 12 either as the tubing enters the mandrel 44 or as the tubing rotates on the mandrel 44. The glue dollop is preferably applied to a corner 76 and located such that each corner 76 of the coil 10 will be glued to the adjacent wrap 13 when the glue sets.

The addition of an automatic coil separating cutter 202 facilitates the continuous manufacture of coils 10 by automatically separating and sizing the coil 10 as it reaches the end plate 70. The coil separating cutter 202 operates whenever the appropriate number of wraps 13 have been formed. The coil separating cutter 202 severs the spine fin tubing 12, preferably on a sloping side 148, so as to separate a formed coil 10 from a coil being formed.

It is also preferable that a circuit cutter 204 be located and operated to automatically make the cuts 25 which are later used to form separate refrigeration circuits or subcooling circuits. Preferably the circuit cutter 204 cuts every third wrap but, of course, this will vary with the size of the coil 10 and the application to which the coil will be applied.

FIG. 14 is an alternative embodiment of the helix forming unit 48 where the cam track is replaced with a cam groove 300. In this alternative embodiment like reference numerals are used to describe like components.

In this alternative embodiment, the cam 110 includes a cylindrical drum-like extension 302 which includes a continuous subsurface cavity 304 around the extension 302 and forming the cam groove 300. The cam followers 160 ride in the cam groove 300 so that heat exchanger coils 10 are formed as previously described. The sides 140, 142, 144 and 146 transliterate as the respective cam follower travels the cam groove 300. In the embodiment of FIG. 14 the path followed is the same as that shown in FIG. 12 but formed as a cam groove 300 rather than a track 114.

The forming block 112 rotates with the mandrel but does not transliterate axially. To radially restrain the sides 140, 142, 144, 146, the sides 140, 142, 144, 146 include a groove 316 in which a retaining cap 318 is positioned to assist and radially restraining the sides 140, 142, 144, 146. A retaining cap 318 is affixed to the forming block 112. Each side 140, 142, 144, 146 can be shaped to form around the extension 302.

While one embodiment of a heat exchanger forming apparatus and a method for continuously forming such heat exchanger have been disclosed in detail herein, it should be understood that various changes may be made without departing from the scope of the present invention.

What is claimed is:

1. A forming device for continuously forming a heat exchanger comprising:

a rotatable shaft;

motor apparatus operably engaged with the shaft for rotating the shaft;

a mandrel affixed to the shaft and rotating with the shaft;

a helix forming unit, movably engaged with the mandrel so as to rotate with the mandrel, and freely transliterating in a direction generally perpendicular to the direction of rotation; and a stationary stock guide for feeding spine fin tubing to the helix forming unit.

2. A forming device for continuously forming a heat exchanger as claimed in claim 1 including displacement apparatus transliterating the helix forming unit approximately distance equal to a diameter of the spine fin tubing.

3. A forming device for continuously forming a heat exchanger as claimed in claim 1, the heat exchanger having a helically wound fin tube coil formed by a plurality of wraps:

the mandrel having a central axis and a plurality of forming corners equiangularly disposed about and displaced from said central axis, the rotation of said mandrel being about said central axis bending the fin tube coil to wind the wraps of the fin tube coil on the mandrel forming corners;

the helix forming unit including a forming block rotationally coupled to the mandrel for rotation therewith and slideably engaged with the mandrel for axial translation a selected distance with respect to the mandrel, the forming block guiding the winding of the fin tub coils onto the mandrel; and further including a timed actuator operably coupled to the forming block and causing the axial translation of the forming block, said axial translation being selectively timed with the rotation of the mandrel forming corners, whereby the wraps of the fin tube coil wound on the mandrel are iteratively axially translated a selected distance with respect to the mandrel to define a continuous helix having a desired wrap pitch, shape, and spacing.

4. A forming device for continuously forming a heat exchanger as claimed in claim 3 wherein the number of iterative axial translations of the wraps of the fin tube coil per revolution of the mandrel is equal to the number of said plurality of mandrel forming corners.

5. A forming device for continuously forming a heat exchanger as claimed in claim 3 further including the fin tube coil being substantially circular in cross-section and having a selected diameter, wherein the iterative translation distance of each iterative axial translation of the wraps of the fin tube coil with respect to the mandrel is substantially equal to the diameter of the fin tube coil.

6. A forming device for continuously forming a heat exchanger as claimed in claim 3 wherein said selectively timing of said axial translation of the wraps of the fin tube coil is such that the axial translation of the wraps of the fin tube coil occurs in conjunction with the fin tube coil being wound over a mandrel forming corner.

7. A forming device for continuously forming a heat exchanger as claimed in claim 3 wherein said timed actuator is a cam having at least one cam follower, the at least one cam follower being in operable engagement with said cam.

8. A forming device for continuously forming a heat exchanger as claimed in claim 7 wherein the cam defines a circular cam groove, the at least one cam follower being in operable engagement with the circular cam groove.

9. A forming device for continuously forming a heat exchanger as claimed in claim 7 wherein said cam defines a circular cam track, said at least one cam follower being in operable engagement with said circular cam track.

10. A forming device for continuously forming a heat exchanger as claimed in claim 9 wherein said cam is fixedly disposed with respect to the mandrel and said at least one cam follower is coupled to the mandrel for rotation therewith, the rotation of the mandrel causing said at least one cam follower to ride on said circular cam track.

11. A forming device for continuously forming a heat exchanger as claimed in claim 10 wherein the number of cam followers corresponds to the number of mandrel forming corners.

12. A forming device for continuously forming a heat exchanger as claimed in claim 10 wherein the cam follower is a roller that is rotationally coupled to an axle, the axle being radially disposed with respect to the central axis.

13. A forming device for continuously forming a heat exchanger as claimed in claim 1 wherein the stock guide unit is adapted to guide a supply of spine fin tubing comprising the fin tube coil from a storage device to the mandrel, the rotation of the mandrel drawing the tube coil spine fin tubing through the stock guide unit, the stock guide unit being in a fixed disposition with respect to the mandrel.

14. A forming device for continuously forming a heat exchanger as claimed in claim 13 wherein the stock guide unit includes apparatus effecting a bend in the fin tube coil spine fin tubing that is oppositely directed to the bend that mandrel effects in the fin tube coil spine fin tubing as the fin tube coil spine fin tubing is wound onto the mandrel.

15. A forming device for continuously forming a heat exchanger as claimed in claim 14 wherein the stock guide unit includes a snubber imparting resistance to the fin tube coil spine fin tubing being drawn through the stock guide unit by the rotation of the mandrel.

16. A forming device for continuously forming a heat exchanger as claimed in claim 3 wherein the forming block includes segments between each pair of adjacent forming corners, the segments being axially movable and having a heat exchanger forming face.

17. A forming device for continuously forming a heat exchanger as claimed in claim 16 wherein all but one segment face are arranged in a common plane.

18. A forming device for continuously forming a heat exchanger as claimed in claim 17 wherein the "all but one" segment face is sloped from one end to another end a distance approximately that of the fin tube coil diameter.

19. A forming device for continuously forming a heat exchanger as claimed in claim 1, further including a gluing device to automatically apply a dollop of glue on the tubing either as the tubing enters the mandrel or as the tubing rotates on the mandrel.

20. A forming device for continuously forming a heat exchanger as claimed in claim 1, further including a separating cutter for severing a formed coil from a coil being formed.

21. A forming device for continuously forming a heat exchanger as claimed in claim 1 further including a circuit cutter for cutting the tubing and thereby dividing the heat exchanger into a plurality of circuits.

* * * * *